US007048074B2

(12) United States Patent
Puttmann

(10) Patent No.: US 7,048,074 B2
(45) Date of Patent: May 23, 2006

(54) CONTROL SYSTEM FOR A PERCUSSION DRIVE

(75) Inventor: Franz-Josef Puttmann, Lennestadt (DE)

(73) Assignee: Tracto-Technik GmbH (DE)

( * ) Notice: Subject to any disclaimer, the term of this patent is extended or adjusted under 35 U.S.C. 154(b) by 0 days.

(21) Appl. No.: 10/223,554

(22) Filed: Aug. 19, 2002

(65) Prior Publication Data

US 2003/0051889 A1 Mar. 20, 2003

(30) Foreign Application Priority Data

Sep. 18, 2001 (DE) ..... 101 46 023

(51) Int. Cl.
*E21B 7/26* (2006.01)

(52) U.S. Cl. ..... 173/91; 173/211; 175/19; 175/296

(58) Field of Classification Search ..... 173/90, 173/91, 93.5, 93.6, 211, 212; 175/296, 297, 175/299, 19, 92
See application file for complete search history.

(56) References Cited

U.S. PATENT DOCUMENTS 3,924,690 A * 12/1975 Shaw ..... 173/13
4,383,581 A 5/1983 Shalashov et al.
4,648,746 A * 3/1987 Abinett ..... 173/91
4,683,960 A * 8/1987 Kostylev et al. ..... 173/91
5,148,878 A 9/1992 Schmidt et al.
5,960,892 A * 10/1999 Balve et al. ..... 173/91
6,062,322 A * 5/2000 Beccu et al. ..... 173/91
6,454,026 B1 * 9/2002 Shofner ..... 173/91
6,615,933 B1 * 9/2003 Eddison ..... 175/284
6,755,593 B1 6/2004 Wentworth et al.
6,761,507 B1 7/2004 Wentworth et al.
2003/0044238 A1 3/2003 Wentworth et al.
2003/0152428 A1 8/2003 Wentworth et al.
2003/0165360 A1 9/2003 Wentworth et al.

FOREIGN PATENT DOCUMENTS

DE 39 09 567 C2 9/1990
DE 42 25 701 C1 12/1993

* cited by examiner

*Primary Examiner*—Scott A. Smith
(74) *Attorney, Agent, or Firm*—Cook, Alex, McFarron, Manzo, Cummings & Mehler, Ltd.

(57) ABSTRACT

The invention relates to a control system for a percussion drive of an earth drilling unit having a housing, a drilling tool, a pulling or thrusting drive, a percussion piston, a pressure chamber belonging to the percussion piston and a pressure medium feed, which can be connected and disconnected, for the operation of the percussion piston, wherein the connecting and disconnecting of the pressure medium feed occurs when the pulling or thrusting drive exceeds or falls below a specific pull or thrust.

4 Claims, 2 Drawing Sheets

CONTROL SYSTEM FOR A PERCUSSION DRIVE

The invention relates to a control system for a percussion drive, in particular for an earth drilling unit having a pulling and thrusting drive and a pressure medium feed for the operation of the percussion drive, and claims the priority of the German Patent Application 10146023.6, to the content of which reference is made.

Percussion drives are used during dynamic horizontal earth drilling and are generally operated hydraulically, from time to time pneumatically. In this case, it is known to change over the units in terms of their forward drive direction, as disclosed by DE 39 09 567 C2, for example.

In the prior art, percussion drives are also used in combination with a static drilling-string drive. Here, however, there is a risk of damage to the drill string or even to the thrusting or pulling drive, in particular when the ground or the old pipe opposes little resistance to the percussion drive and the drill string has to be thrust or pulled only at a low speed, the percussion energy being introduced to a large extent completely into the drill string and to the thrusting or pulling drive.

In the case of relatively long sections of low resistance, the operator can disconnect the percussion drive, depending on the conditions in the channel to be drilled. For example, drilling sections in which the ground opposes little resistance can be overcome purely statically, while in more solid ground the percussion drive is connected.

However, this procedure depends on the reaction of the operator and, at the same time, is naturally restricted to relatively long drilling sections with a resistance that fluctuates little. Even in the case of relatively long drilling sections with a constant resistance, there is the problem that the manual connection and disconnection can be carried out too late or too early, and therefore excessive loadings for the drill string also remain in this case.

In practice, it is further to be observed that the start-up time when connecting the percussion drive leads to undesirable delays, since the pressure medium system first has to fill with pressure medium if it is connected manually, in order only then to set the percussion piston moving. It is important, in particular for the reliable response of the piston, that the build-up of pressure takes place abruptly. Thus, in the case of the known percussion drives which are connected and disconnected manually above ground, it can occur that the percussion piston assumes a dead position when the pressure medium is connected and does not respond, since the build-up of pressure via the feed line takes place too slowly.

The invention is based on the object of providing an improved device with a percussion drive and a corresponding method.

The object is achieved by the independent patent claims. Advantageous refinements can be gathered from the dependent claims.

The invention is based on the idea of providing automatic connection or disconnection of the percussion drive for an earth drilling unit.

In this case, the earth drilling unit has a pulling or thrusting drive with pulling or thrusting means, a percussion piston, a pressure chamber belonging to the percussion piston and a pressure medium feed that can be connected or disconnected for the operation of the percussion piston, the pressure medium feed being connected or disconnected when the pulling or thrusting drive exceeds or falls below a specific pull or thrust.

The device according to the invention therefore permits drilling in the ground with a static drive which, at the same time, is assisted by a percussion drive, the percussion drive being disconnected automatically in sections of lower resistance, the percussion drive being connected again when a specific preselected resistance is reached. This permits drilling with a minimum loading on the drill string and on the drive, since it is not only bouncing impacts which are avoided and, in this way, the percussion energy can always be introduced into the drill string and the drive only to a certain proportion. Here, however, excessive loading of the drill string, originating from the static drive, is also avoided, in that the percussion drive is connected automatically in sections of higher resistance.

According to the present invention, both percussive and nonpercussive operation can be provided in the basic position.

Means for connecting or disconnecting the pressure medium feed are preferably provided in the form of a pressure chamber inside the housing of the drilling unit, it being possible for the pressure chamber to have a valve or a through hole as a connection from the pressure medium source to the pressure chamber of the percussion piston.

Furthermore, the means for connecting or disconnecting the pressure medium feed can be capable of actuation via the pulling or thrusting means. In practice, the drill string can serve as an initiator for connecting or disconnecting the percussion drive. However, the invention can also be implemented via the pull on a hose, which can be fitted to the head of the earth drilling unit, or via a control cable. Other possible connection/disconnection methods are conceivable.

In a further preferred embodiment of the invention, the chamber inside the housing can be displaced axially between two positions via the pulling or thrusting means and is constructed in the form of a pressure tube, the valve or the through hole being open in one position and closed in a second position.

If the percussion drive has a control pipe, for example for changing over the forward drive direction of the percussion drive, the pressure tube can be arranged within the control pipe, and the control pipe can open the through hole in one position and close it in a second position.

The pressure tube is preferably fixed by a spring element in a basic position with the valve open or closed or the through hole open or closed. Thus, depending on the refinement of the invention, it is possible for the percussion drive to be connected or disconnected when the spring force is overcome.

The chamber or the pressure tube can be connected with a supply line running through the percussion piston to the drilling tool.

The pressure tube or the pressure chamber is preferably continuously supplied with pressure medium, so that firstly a permanent pressure is available directly beside the pressure chamber of the percussion piston, ensures reliable abrupt response of the piston and, furthermore, when a compressed air feed line to the drilling tool is used, compressed air is still available as a cooling medium during drilling even when the percussion drive is disconnected.

An earth drilling unit in the sense of this invention is to be understood in particular as any unit which is moved in an existing channel or one to be created, in order to create a pilot hole or to widen it or to replace an existing pipe in a destructive or nondestructive manner, to clean the pipe, to pull lines into existing pipes or other elongate bodies, and all devices for structural work by the underground forward drive. The earth drilling unit in the sense of this invention is, by its nature, not restricted to underground work, however. For example, lines which are cleaned by an earth drilling unit can also run above ground.

In the sense of the present invention, a channel is understood to mean any type of earth drilling or earth line or pipeline which, by using an appropriate tool, may be widened, destroyed, cut open or cleaned.

The term tool in the sense of this invention comprises any desired widening, cutting, bursting or scraping tool, which can be arranged at any desired point on a drilling unit or drill string.

The invention will be explained in more detail in the following text using an exemplary embodiment illustrated in the drawing, in which:

FIG. 2 shows the hammer drilling lance of FIG. 1 with the percussion drive switched on;

Figure 1:
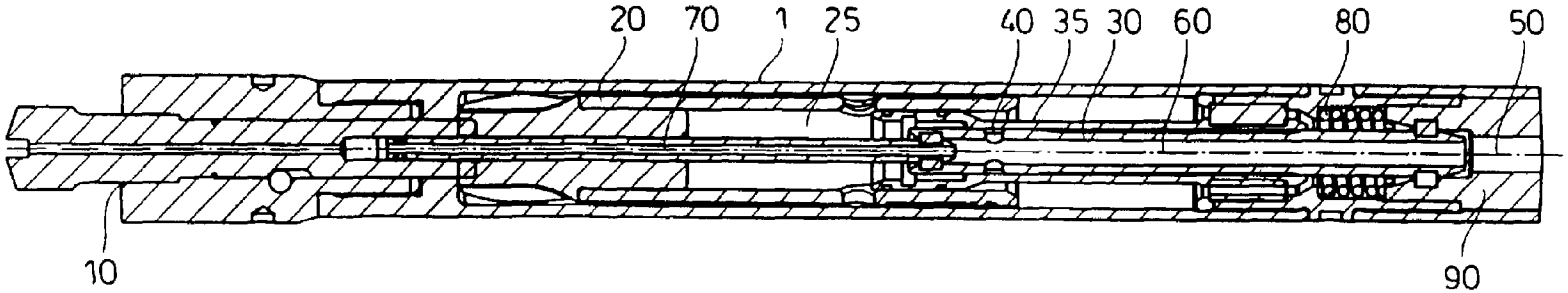
FIG. 1 shows a hammer drilling lance configured in accordance with the invention in the basic position for nonpercussive operation.

In a housing 1 having a drilling tool 10 and a percussion piston 20, a pressure tube 30 with a through hole 40 is arranged such that it can be displaced between two end positions. The pressure tube is arranged in a control pipe 35 for changing over the operating direction of the drilling unit.

Via a feed line 50, an operating medium for the percussion piston and/or a drilling medium are provided. The operating medium, preferably compressed air, is present in a pressure chamber 60 of the pressure tube 30 and, in the basic position of the pressure tube illustrated in FIG. 1, is led to the drilling head or the drilling tool 10 via a feed line 70. In this case, the through hole 40 is closed by the control pipe 35.

The pressure tube 30 maintains the basic position illustrated in FIG. 1 by means of a spring 80.

In the embodiment described, the drilling unit is moved through the ground by a thrusting drive provided by a drill string, the thrusting force being transmitted to the drilling unit via a drill string adapter 90. If the back pressure exceeds a specific value predefined by the spring 80, for example on account of too great a resistance in the rock face, the spring 80 is compressed by the drill string adapter 90 that can be displaced in the housing 1, and the pressure tube 30 is displaced axially on this path within the housing, so that the through hole 40 is opened and the pressure chamber 60 is connected to the pressure chamber 25 of the percussion piston. Since the pressure for the operation of the percussion piston 20 is already present in the pressure chamber 60 of the pressure tube when the pressure tube 30 is displaced, the percussion piston is set operating abruptly on account of the abrupt build-up of pressure in the pressure chamber 25, so that reliable response of the piston is ensured.

Figure 2:
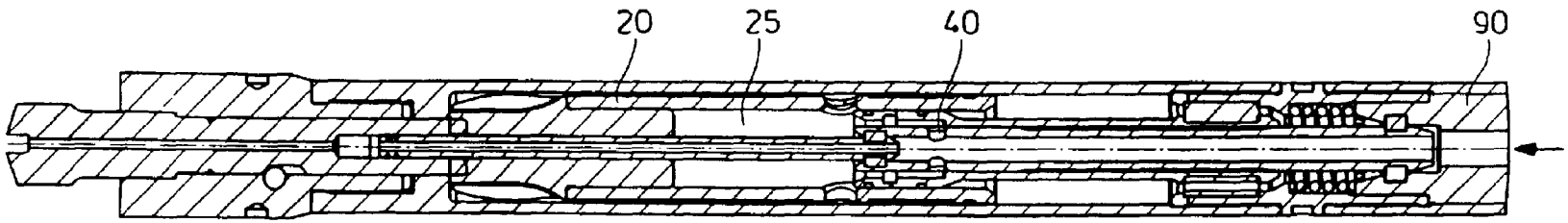

As soon as the forward drive pressure from the thrust linkage falls below the value defined by the spring 80 again, the expansion of the spring 80 guides the pressure tube 30 back into its basic position, as a result of which the pressure medium feed to the percussion piston 20 and to its pressure chamber 25 is interrupted again. These two functional positions are illustrated in FIGS. 1 and 2.

During the entire operation, compressed air and/or drilling liquid is led to the drilling head 10 via the channel 70, so that even when the percussion drive is disconnected, no overheating of the tool 10 takes place and it is possible to ensure that the debris is transported away.

Figure 3:
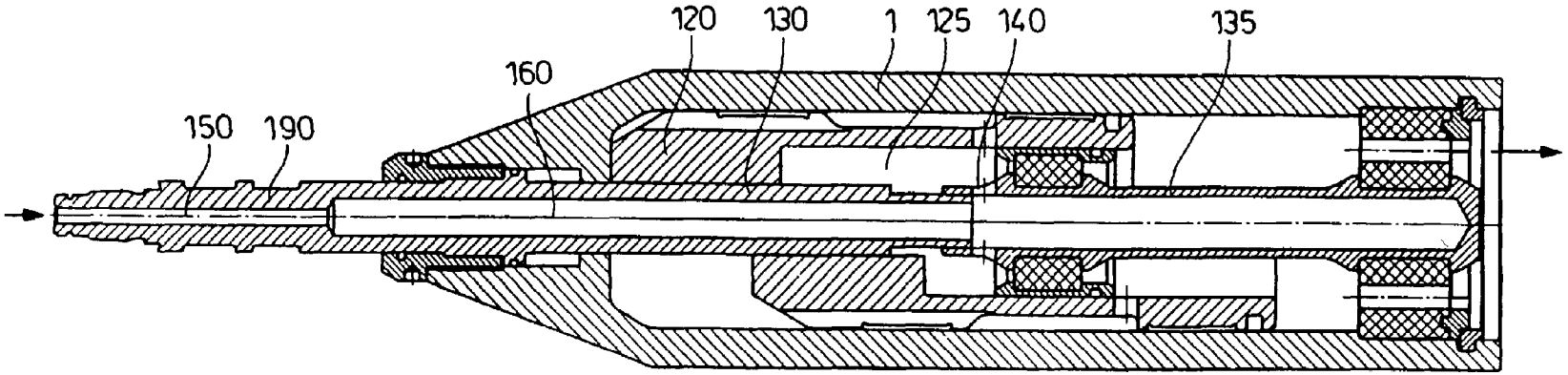
FIG. 3 shows a back reamer configured in accordance with the invention in the basic position for percussive operation.
Figure 4:
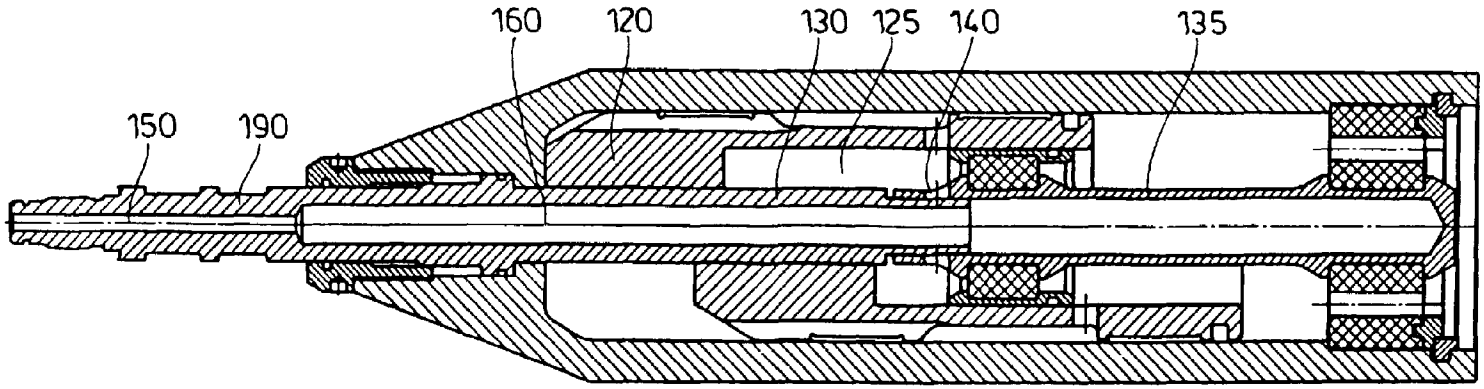
FIG. 4 shows the back reamer according to FIG. 2 with the percussion drive disconnected.

In the case of another embodiment, illustrated in FIGS. 3 and 4, the invention is implemented in a type of "emergency shutdown". In this case, the housing 1 has a percussion piston 120, a pressure tube 130 and through holes 140. The pressure tube has a pressure chamber 160, which is supplied with compressed air via a feed line 150. In this embodiment, although the pressure tube can likewise be displaced axially within the housing 1, in its basic position it leaves the through holes 140 open as a connection to the pressure chamber 125 of the percussion piston 120.

In this embodiment, the earth drilling unit in the form of a back reamer is moved through the ground via a pulling linkage, the pulling force being transmitted to the housing 1 via a linkage adapter 190. During the static forward drive, the back reamer is supported by the percussion drive in its basic position. As a result of axial displacement of the pressure tube 130, the through hole 140 is closed in the case in which the resistance in the rock face falls below a specific value. This prevents the percussion drive transmitting the full percussion force to the linkage or the static drive or, in the case of a pulling cable or hose, prevents it travelling over the latter in the pulling device. The spring element is set in such a way that a low tension is already sufficient to start up the percussion piston. In this case, the basic position of the operation is characterized by an open through hole 140 and a prestressed spring element, since the rock face provides the pressure necessary to contract the spring element in the basic operation. If this pressure drops, the spring is relieved of pressure, so that—as described—the axial displacement of the pressure tube 130 has the effect of closing the through holes 140. In this exemplary embodiment, too, when the through hole 140 is closed, there is a permanent pressure in the pressure chamber 160 of the pressure tube 130, so that starting up the percussion drive without difficulty is ensured.

In both cases, the percussion piston 120 can slide on the compressed-air or drilling-medium channel 130, 70.

With the invention described, a percussive drilling unit can be combined in an operationally reliable manner with a static thrusting or pulling drive, without there being the risk of damage to the thrusting or pulling drive or its thrusting or pulling elements.

What is claimed:

1. A control system for a percussion drive of an earth drilling unit having a housing, a drilling tool, a pulling or thrusting drive with pulling or thrusting means, a percussion piston, a pressure chamber belonging to the percussion piston and a pressure medium feed, which can be connected and disconnected, for the operation of the percussion piston, comprising:

a pressure tube including a wall defining a pressure chamber within said tube, said pressure tube having a valve or a through-hole in the wall of said tube to provide a connection from the pressure medium feed to the pressure chamber belonging to the percussion piston;

said pressure tube being mounted such that it can be displaced axially between two positions via the pulling or thrusting means within said housing, whereby said valve or through-hole is open in one position and closed in a second, axially displaced position;

wherein said pressure tube is held by a spring element in a basic position with the valve closed or the through-hole closed.

2. The control system as claimed in claim 1, wherein the connecting or disconnecting of the pressure medium feed can be actuated via the pulling or thrusting means.

3. The control system as claimed in claim 1, having a control pipe, wherein the pressure tube is arranged within the control pipe and the control pipe opens the through-hole in one position and closes it in a second position.

4. The control system as claimed in claim 1, wherein the chamber of the pressure tube is connected to a supply line running through the percussion piston to the drilling tool.

* * * * *